US009925413B1

(12) United States Patent
Heisserman

(10) Patent No.: US 9,925,413 B1
(45) Date of Patent: Mar. 27, 2018

(54) EXERCISE DEVICE

(71) Applicant: Douglas Heisserman, Maui, HI (US)

(72) Inventor: Douglas Heisserman, Maui, HI (US)

( * ) Notice: Subject to any disclaimer, the term of this patent is extended or adjusted under 35 U.S.C. 154(b) by 0 days.

(21) Appl. No.: 15/706,571

(22) Filed: Sep. 15, 2017

(51) Int. Cl.

| | |
|---|---|
| ***A63B 21/00*** | (2006.01) |
| ***A63B 22/16*** | (2006.01) |
| *A47C 9/10* | (2006.01) |
| *A47C 9/00* | (2006.01) |
| *A63B 22/14* | (2006.01) |

(52) U.S. Cl.
CPC ..... *A63B 22/16* (2013.01); *A63B 21/4033* (2015.10); *A47C 9/002* (2013.01); *A47C 9/105* (2013.01); *A63B 22/14* (2013.01); *A63B 2208/0228* (2013.01); *A63B 2208/0233* (2013.01); *A63B 2210/00* (2013.01)

(58) Field of Classification Search
CPC ..... A63B 21/4031; A63B 22/14; A63B 22/16; A63B 23/02; A63B 23/0205; A63B 23/0211; A63B 23/0216; A63B 23/0222; A63B 23/0227; A63B 23/0233; A63B 23/0238; A63B 2208/0228; A63B 2208/0233; A63B 2210/00; A63B 2210/02; A63B 2210/50; A47C 3/0255; A47C 3/18; A47C 9/002; A47C 9/005; A47C 9/105
See application file for complete search history.

(56) References Cited

U.S. PATENT DOCUMENTS

| | | | | | |
|---|---|---|---|---|---|
| 335,823 | A * | 2/1886 | Linden | A47C 9/105 | 248/165 |
| 1,215,689 | A * | 2/1917 | Neff | A47B 3/02 | 108/128 |
| 1,355,944 | A * | 10/1920 | Dale | A47C 9/105 | 108/118 |
| 3,416,792 | A * | 12/1968 | Morgan | A63B 22/16 | 482/146 |
| 3,687,449 | A | 8/1972 | Newman | | |
| 4,708,308 | A * | 11/1987 | Snider | A47C 9/105 | 248/164 |

(Continued)

FOREIGN PATENT DOCUMENTS

| | | |
|---|---|---|
| DE | 202007003177 U1 | 8/2007 |
| EP | 1880702 | 1/2008 |
| FR | 2628329 | 9/1989 |

*Primary Examiner* — Joshua Lee
(74) *Attorney, Agent, or Firm* — Jeffrey G. Sheldon; Katherine Sales; Cislo & Thomas

(57) ABSTRACT

A device useful for exercise having a collapsed and an upright exercise position, the device comprising a collapsible lower frame and a collapsible upper frame. The lower frame has lower frame posts pivotably connected to a base structure. The lower frame post upper portions are linked together by a linking structure such that the lower frame posts form a pyramid structure in the lower frame upright exercise position. The collapsible upper frame has a upper frame posts pivotally connected to a top structure. The upper frame post lower portions are linked together by the linking structure such that the upper frame posts form an inverted pyramid in the upper frame upright exercise position. The linking structure connects the upper frame to the lower frame such that the upper frame can pivot relative to the lower frame when the device is in its upright exercise position.

15 Claims, 8 Drawing Sheets

(56) References Cited

U.S. PATENT DOCUMENTS

| | | | | | |
|---|---|---|---|---|---|
| 4,822,039 | A * | 4/1989 | Gonzales | A63B 21/04 | 482/128 |
| 4,848,742 | A * | 7/1989 | Lindley | A61H 1/0292 | 482/142 |
| 5,044,690 | A * | 9/1991 | Torrey | A47C 4/283 | 108/119 |
| 6,536,732 | B1 * | 3/2003 | Chang | A47B 3/04 | 108/94 |
| 7,048,331 | B2 * | 5/2006 | Saakyan | A47C 4/283 | 297/16.1 |
| 9,474,929 | B2 * | 10/2016 | Wu | A63B 55/53 | |
| 2010/0314926 | A1 * | 12/2010 | Chesness | A47C 4/286 | 297/258.1 |
| 2013/0049410 | A1 * | 2/2013 | Stafford | A47C 3/18 | 297/16.1 |
| 2017/0311723 | A1 * | 11/2017 | Lenhart | A47C 4/28 | |

* cited by examiner

EXERCISE DEVICE

BACKGROUND

Many people desire to exercise, and in order to effectively exercise they require exercise equipment. A staple piece of exercise equipment is the stability ball, which is known by a number of different names, including a Swiss ball, balance ball, birth ball, body ball, ball, fitness ball, gym ball, gymnastic ball, physio ball, Pilates ball, Pezzi ball, Swedish ball, therapy ball, or yoga ball.

The stability ball provides an excellent means of developing balance, and targeting the core muscles that contribute to good balance. However, stability balls are quite large, and take up an undesirable amount of room. They are difficult and bulky to store, and eventually over time lose air and deflate to the point that they are no longer unusable.

Accordingly there is a need for an exercise device that provides the benefits of a stability ball, but does not have the accompanying drawbacks associated with a stability ball.

SUMMARY

The present invention is directed to an exercise device comprising in a first embodiment, the present invention is a device useful for exercise, the device having a collapsed position and an upright exercise position, the device comprising: a) a collapsible lower frame collapsible from a lower frame upright exercise position to a lower frame collapsed position, the collapsible lower frame comprising: (i) a base structure; and (ii) lower frame posts supported by the base structure, each lower frame post having an upper portion and a lower portion pivotably connected to the base structure with the lower frame post upper portions linked together by a linking structure such that the lower frame posts form a pyramid structure in the lower frame upright exercise position and can collapse from the lower frame upright exercise position to the lower frame collapsed position with the base structure and lower frame posts in substantially a lower frame collapsed plane; and b) a collapsible upper frame collapsible from an upper frame upright exercise position to an upper frame collapsed position, the collapsible upper frame comprising: (i) a top structure; and (ii) upper frame posts having a lower portion and an upper portion pivotally connected to the top structure, with the upper frame post lower portions linked together by the linking structure such that the upper frame posts form an inverted pyramid in the upper frame upright exercise position, wherein the upper frame can collapse from the upper frame upright exercise position to the upper frame collapsed position with the top structure and posts in an upper frame collapsed plane; wherein the linking structure connects the upper frame to the lower frame such that the upper frame can pivot relative to the lower frame when the device is in its upright exercise position.

The lower frame can comprise four lower frame posts forming a first and a second pair of lower frames posts, and the upper frame comprises four upper frame posts forming a first and a second pair of upper frames posts.

The linking structure can comprise two upper couplings and two lower couplings, wherein one upper coupling is coupled to the first pair of upper frame posts, the other upper coupling is coupling to the second pair of upper frame posts, one lower coupling is coupled to the first pair of lower frame posts and the other lower coupling is coupled to the second pair of lower frame posts.

Each upper coupling can be pivotally connected to a lower coupling by a connector.

The device can further comprise a latch for securing the lower frame posts in the lower frame upright exercise position and the upper frame posts in the upper frame upright exercise position. The latch can comprise a hook formed in one of the lower couplings and a projection formed in the other lower coupling, the hook configured to latch onto the projection, such that when latched, the lower frame posts are locked in the lower frame upright exercise position and the upper frame posts are locked in the upper frame upright exercise position.

Optionally, the device can further comprise a seat removeably coupled to the top structure.

The base structure of the device can be rectangularly shaped, having four corners and the lower frame comprises four lower frame posts, one lower frame post coupled to the base structure proximate each corner of the base structure.

Each of the four lower frame posts can be pivotally connected to the base structure by a hinge The top structure can be rectangular shaped having four corners and the upper frame comprises four upper frame posts, one upper frame post coupled to the top structure proximate each corner of the top structure.

Each of the four upper frame posts can be pivotally connected to the top structure by a hinge Optionally, the device can further comprise a plurality of feet coupled to the lower frame.

In a second embodiment, the present invention is a method of using a device useful for exercise, the method comprising the steps of: a) obtaining the device of claim 1 in the collapsed position; b) moving the device into the upright exercise position; and c) pivoting the upper frame relative to the lower frame, thus exercising.

The method can further comprise the step of coupling a seat to the top structure.

DRAWINGS

These and other features, aspects, and advantages of the present invention will become better understood with reference to the following description, appended claims, and accompanying drawings where:

DESCRIPTION

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

Figure 1:
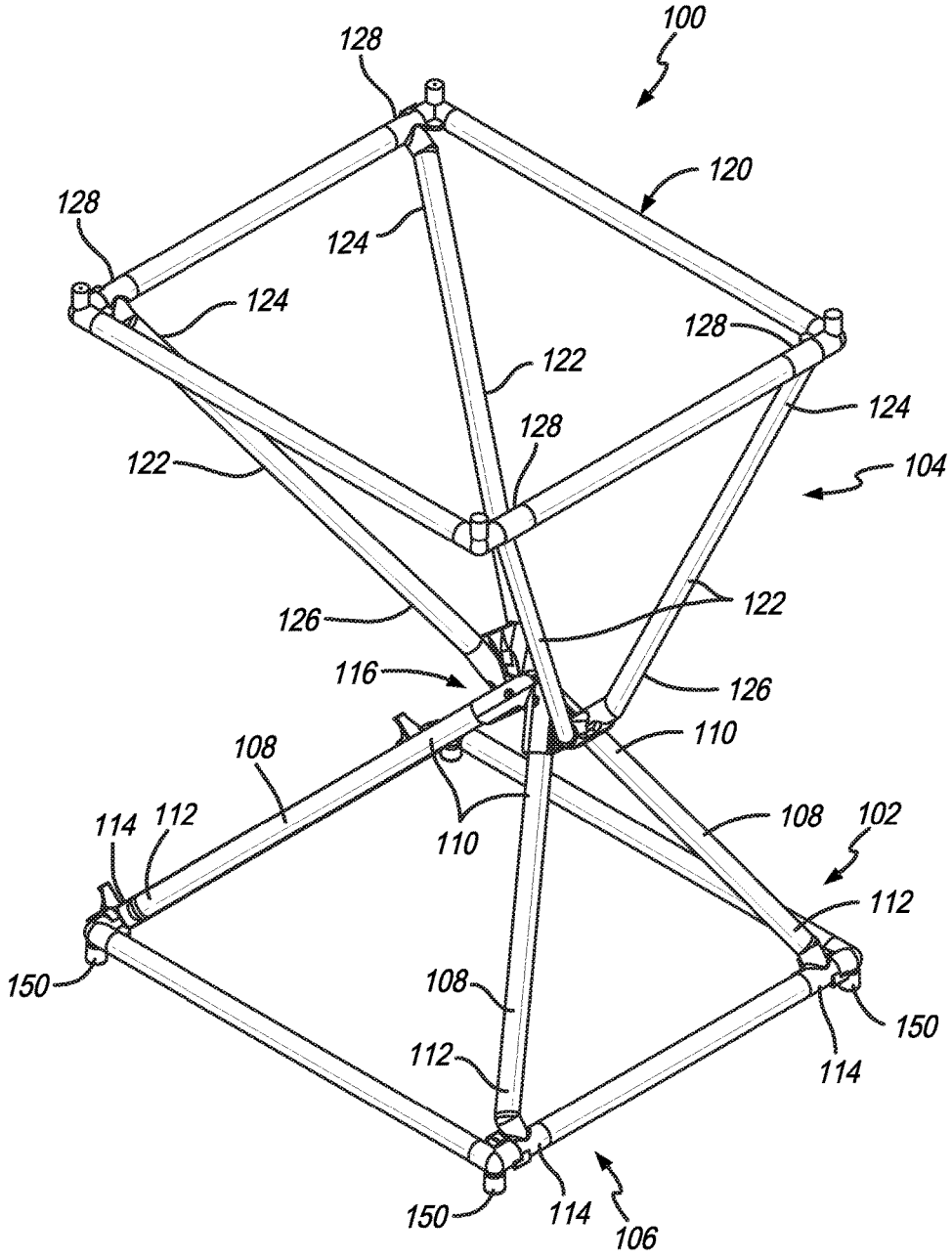
FIG. 1 is a perspective view of an exercise device having features of the present invention.
Figure 2:
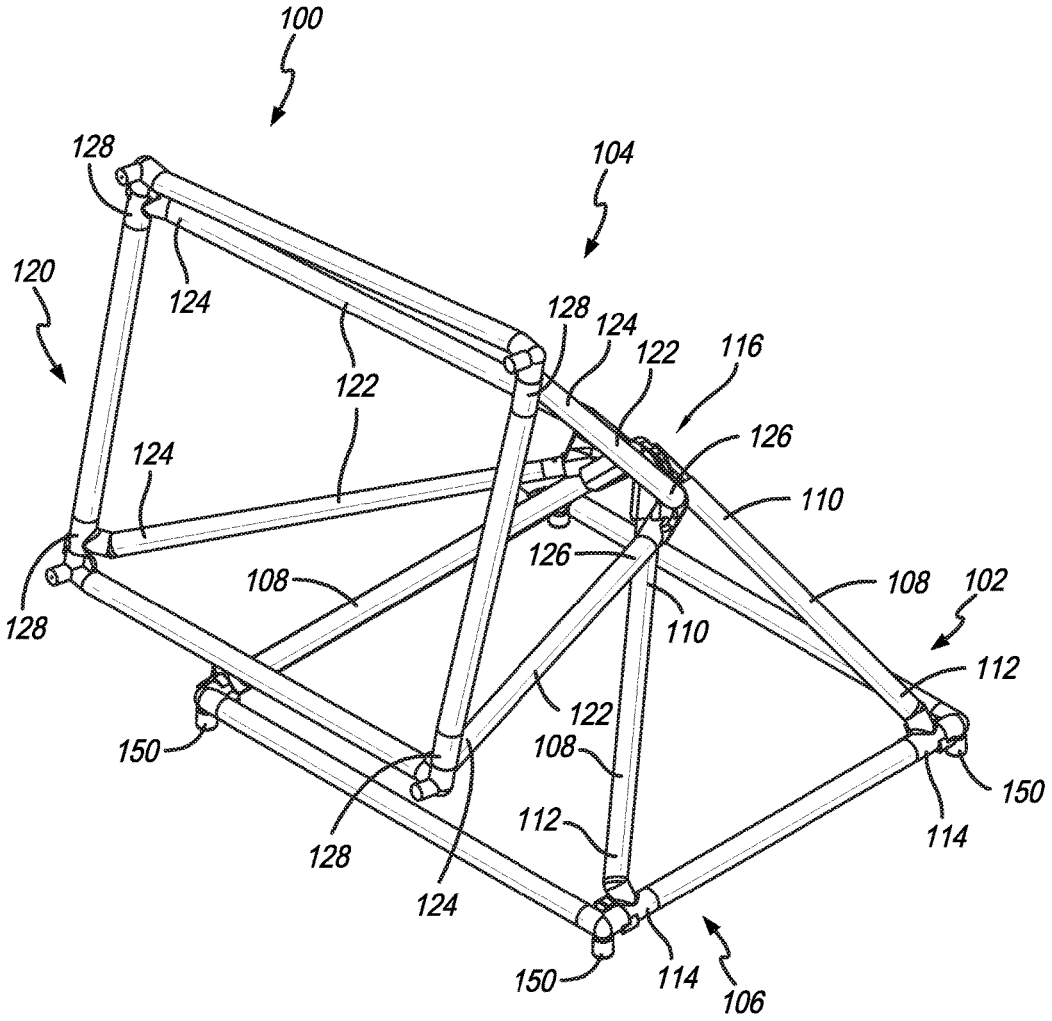
FIG. 2 is a perspective view of the exercise device of FIG. 1, wherein the upper frame has been pivoted relative to the bottom frame.
Figure 3:
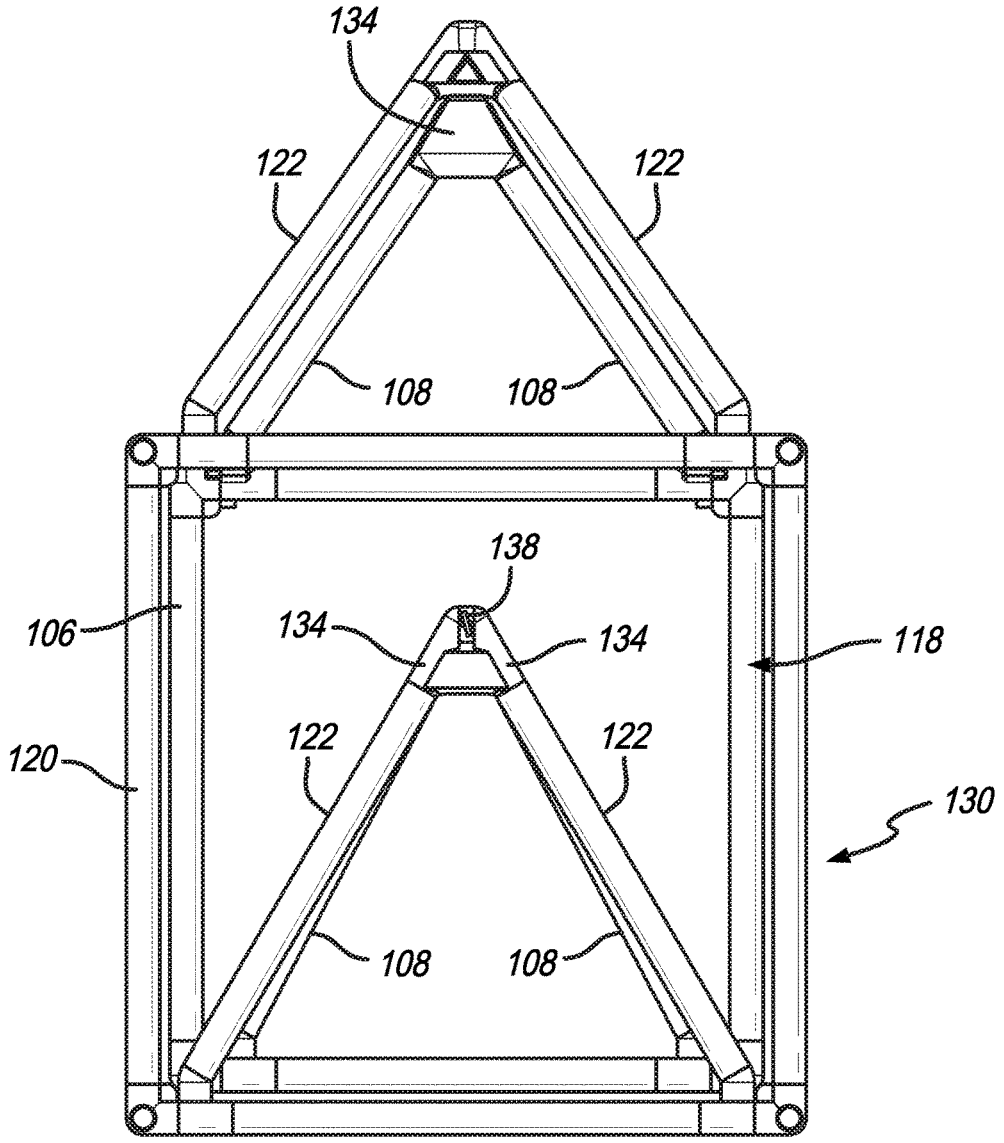
FIG. 3 is a top plain view of the exercise device of FIG. 1, wherein the exercise device has been collapsed into the collapsed position.

Referring now to FIGS. 1 through 3, there is shown a device 100 useful for exercise. FIGS. 1 and 2 show the device 100 in an upright exercise position, and FIG. 3 shows the device 100 in a collapsed position. The device 100 has a collapsible lower frame 102 and a collapsible upper frame 104. The lower and upper frame 102, 104 can be made from metal, wood, or plastic, and can be either solid or hollow. Preferably, the lower and upper frames 102, 104 are made from hollow aluminum tubes, approximately 1 inch in outside diameter. This results in a lightweight and easily portable exercise device 100. The above measurements are for example only, and the measurements can be scaled up or down depending on the specific use and/or size of the user. For example, if the exercise device 100 is for children, the measurements can be scaled down appropriately.

The collapsible lower frame 102 collapses from an upright position shown in FIGS. 1 and 2, to a collapsed position shown in FIG. 3. The collapsible lower frame 102 comprises a base structure 106 and lower frame posts 108 supported by the base structure 106. The base structure 106 is typically in a rectangle shape having four corners, and has the approximate measurements of 11 inches long by 7 inches wide. However, as long as the base structure 106 forms a solid, stable base, the base structure 106 can be in other shapes, such as a triangle, circle, oval, for example. Accordingly, the base structure 106 may not have any corners.

Each lower frame post 108 has an upper portion 110 and lower portion 112. The lower portion 112 of each lower frame post 108 is pivotally connected to the base structure 106. The lower frame 102 can comprise two or more lower frame posts 108, but preferably, as shown in the FIGS., the lower frame 102 comprises four lower frame posts 108. The length of the lower frame posts 108 can vary depending on the application of the device 100, but preferably the lower frame posts 108 are about 6 and ⅝ inches long. Preferably, one lower frame post 108 is connected to the base structure 106 at each corner of the base structure 106 by a hinge 114, such that the lower frame posts 108 can pivot relative to the base structure 106. Optionally the hinge can be a collar hinge 114. If the base structure 106 does not have any corners, then the lower frame posts 108 can be evenly spaced around the base structure 106. All of the upper portions 110 of the lower frame posts 108 are linked together by a linking structure 116 such that the lower frame posts 108 form a pyramid structure in the upright position and can collapse from the lower frame upright exercise position to the lower frame collapsed position with the base structure 106 and the lower frame posts 108 in substantially a lower frame collapsed plane 118, as best shown in FIG. 3.

The collapsible upper frame 104 collapses from an upper frame upright exercise position shown in FIGS. 1 and 2, to an upper frame collapsed position shown in FIG. 3. The collapsible upper frame 104 comprises a top structure 120 and upper frame posts 122 pivotally connected to the top structure 120. The top structure 120 is typically in a rectangle shape having four corners, and has the approximate measurements of 13 inches long by 9 inches wide. However, as long as the top structure 120 forms a solid, stable top, the top structure 120 can be in other shapes, such as a triangle, circle, oval, for example. Accordingly, the top structure 120 may not have any corners.

Each upper frame post 122 has an upper portion 124 and a lower portion 126. The upper portion 124 of each upper frame post 122 is pivotally connected to the top structure 120. The upper frame 104 can comprise two or more upper frame posts 122, but preferably, as shown in the FIGS., the upper frame 104 comprises four upper frame posts 122. The length of the upper frame posts 122 can vary depending on the application of the device 100, but preferably the upper frame posts 122 are about 8.5 long. Preferably, one upper frame post 122 is connected to the top structure 120 at each corner of the top structure 120 by a hinge 128 such that the upper frame posts 122 can pivot relative to the top structure 120. Optionally the hinge 128 can be a collar hinge. If the top structure 120 does not have any corners, then the upper frame posts 122 preferably are evenly spaced around the top structure 120. All of the lower portions 126 of the upper frame posts 122 are linked together by the linking structure 116 such that the upper frame posts 122 form an inverted pyramid in the upright position, as shown in FIGS. 1 and 2. The upper frame 104 can collapse from the upper frame upright exercise position to the upper frame collapsed position with the top structure 120 and posts 122 in an upper frame collapsed plane 130, as shown in FIG. 3.

FIG. 2 shows the upper frame 104 having been pivoted relative to the lower frame 106. This pivoting movement of the upper frame posts 122 allows the user to perform many different exercises utilizing the exercise device 100. The lower frame 106 rests securely and stably upon a ground surface, and the user can sit or lean or hold the upper frame 104 and pivot it accordingly. By pivot it is meant that the upper frame 104 can rotate 360 degrees around the pivot point, and the upper frame 104 can be titled to any angle relative to the lower frame, and rotated clockwise or counter clock wise 360 degrees around the pivot point.

Figure 4:
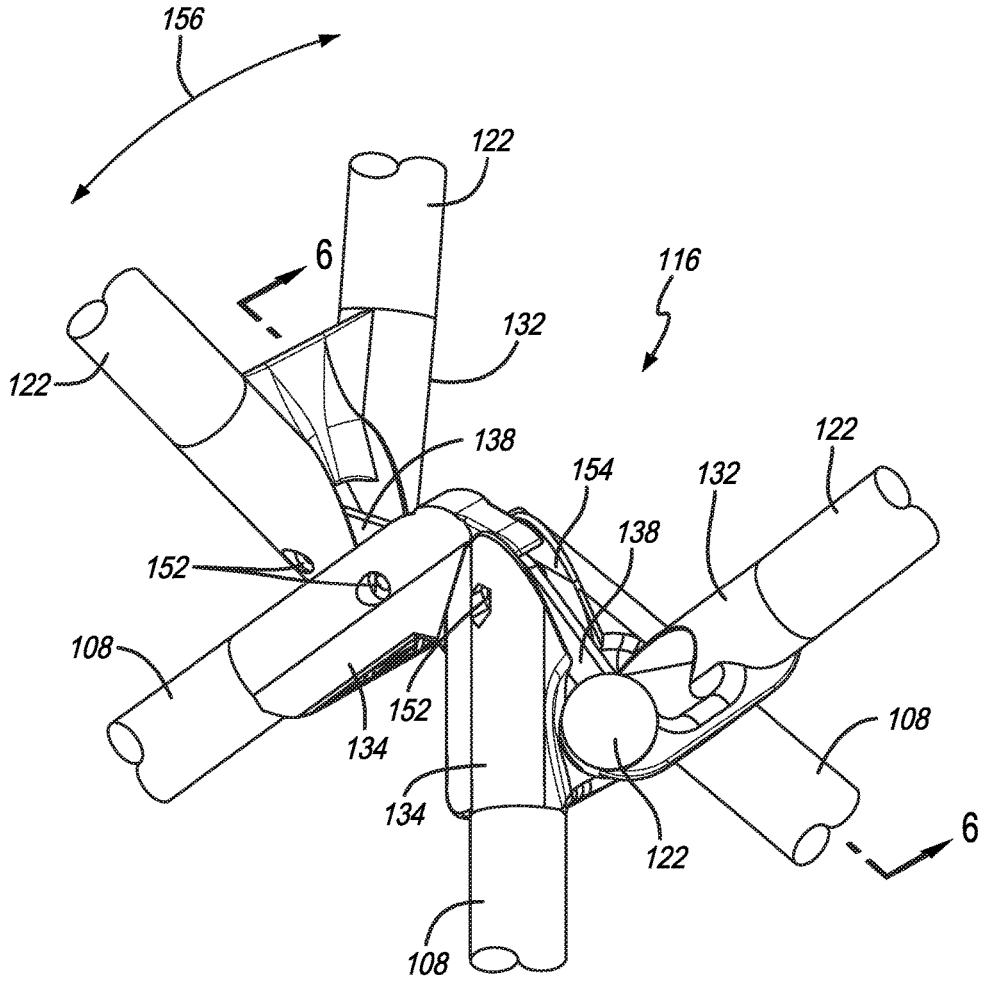
FIG. 4 is perspective view of the linking structure of the exercise device of FIG. 1.

Referring now to FIG. 4, the linking structure 116 is shown. At a minimum, the linking structure 116 comprises an upper structure linking the upper frame posts 122, a lower structure linking the lower frame posts 108, and pivot/rotation mechanism between the upper and lower structures. The linking structure 116 can comprise a single structure, or multiple individual components that together perform the necessary linking and pivoting functions.

Figure 5:
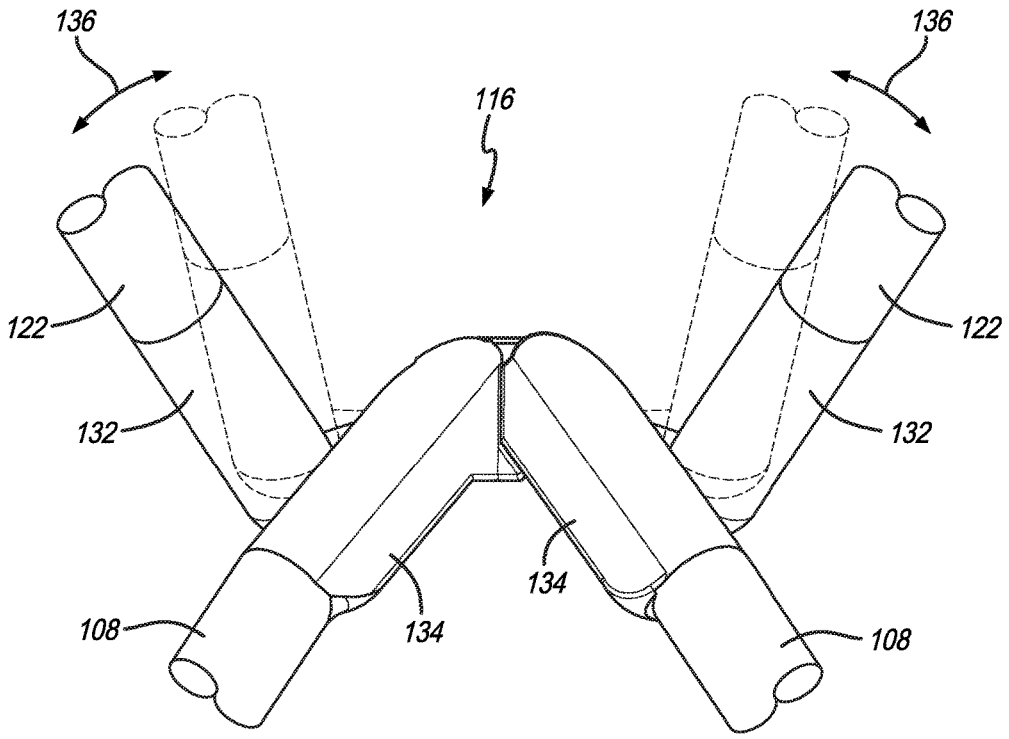
FIG. 5 is a front plan view of the linking structure of the exercise device of FIG. 1, wherein the movement upper frame posts is shown.

As shown in FIG. 4, the upper frame posts 122 are coupled the linking structure 116 in pairs, each pair coupled by an upper coupling 132 (typically V-shaped) that comprises a moveable portion of the linking structure 116. The lower frame posts 108 are also coupled to the linking structure 116 in pairs, each pair coupled by a lower coupling 134 (typically V-shaped) that comprises a non-moveable portion of the linking structure 116. As shown in FIG. 5, the moveable portion of the linking structure 116 permits the upper frame posts 122 to pivot (or rotate) relative to the lower frame posts 108 (indicated by arrows 136), while the lower frame posts 108 remain stationary. The lower and upper couplings 132, 134 can be made from plastic or metal, and can have sleeves for receiving the lower and upper frame posts 108, 122.

Figure 6:
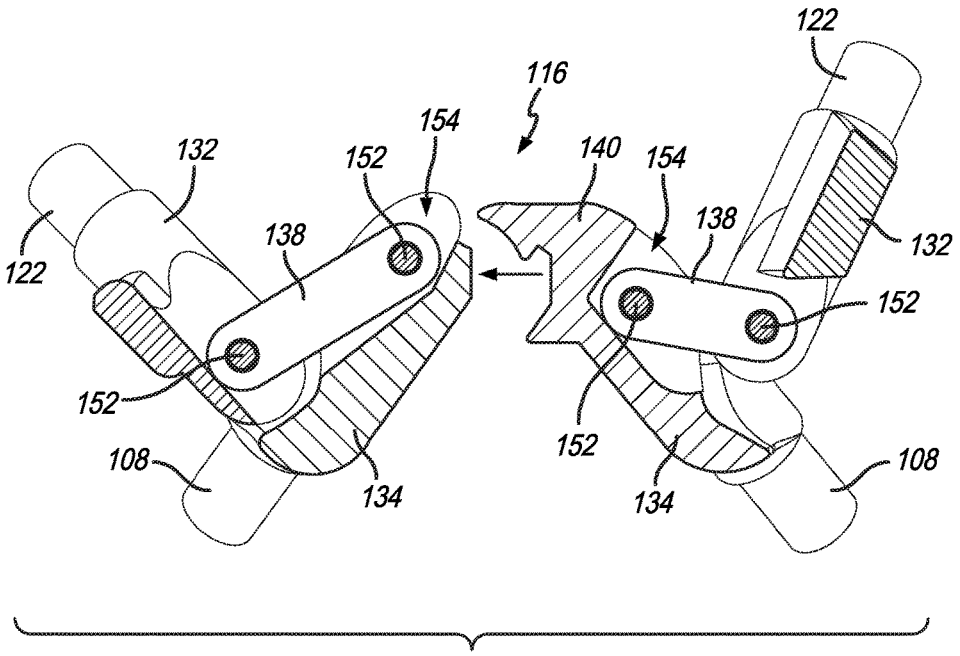
FIG. 6 is sectional view of the linking structure of FIG. 4 taken along line 6-6 in FIG. 4, wherein a hook and projection are unlatched, and the latching movement is shown with an arrow.
Figure 7:
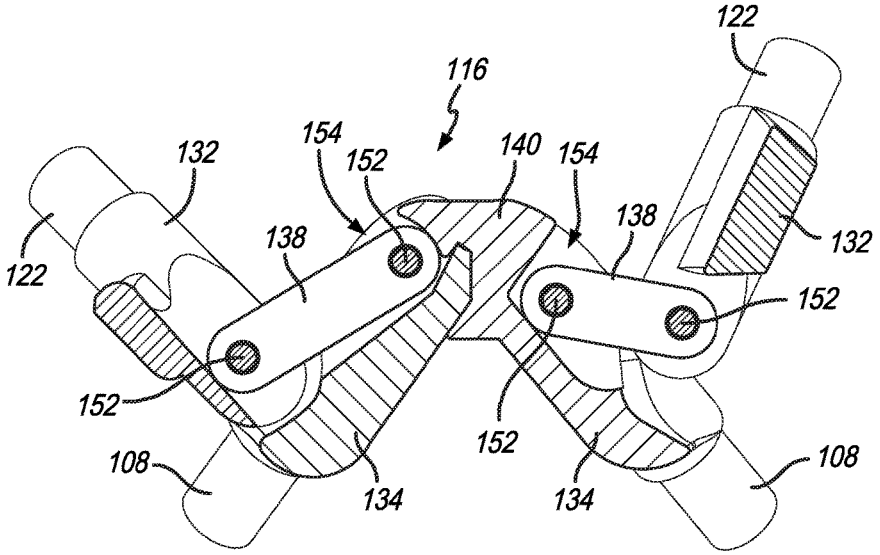
FIG. 7 is a sectional view of the linking structure of FIG. 6, wherein a hook and projection are latched.

As can be seen in FIGS. 6 and 7, the lower coupling 134 does not permit any pivoting or rotational movement of the lower frame posts 108 with respect to the upper frame 104. Only the upper frame posts 122 can move. Each upper coupling 132 is coupled to its respective lower coupling 134 by a connector 138. Each end of the connectors 138 has an aperture through which a pair of bolts 152 pass, pivotally or rotationally coupling the connector 138 to both the upper coupling 132 and the lower coupling 134. Optionally the bolts 152 can be pop rivets, or any other type of fastener that achieves the same degree of movement. The apertures in the connectors 138 have an inner diameter that is larger than the outer diameter of the pair of bolts 152. This difference in diameters creates free space between the apertures of the connectors 138 and the bolts 152 that allows the connectors 138 to pivot/rotate from side to side and contributes to the range of motion the upper frame 104 is able to achieve, as shown by arrow 156 in FIG. 4. The two connectors 138 can be from about 1 inch long to about 4 inches long, but preferably, as can be seen in FIGS. 6 and 7, one of the connectors 138 is shorter than the other, such that one connector 138 is 2.2 inches long and the other connector 138 is 2.6 inches long. The length of the connectors 138 can be scaled up or down depending on the application of the device 100.

As can be seen in FIG. 4, each of the connectors 138 lie within a slot 154 disposed in the lower coupling 134. The width of the slots 154 is greater than the widths of the connectors 138, and this difference in width creates free space in which the connectors 138 are free to pivot from side to side, contributing to the range of motion the upper frame 104 is able to achieve shown by arrow 156.

As best shown in FIGS. 6 and 7, the linking structure 116 also comprises a latch. The latch can be formed by a hook 140 and a projection 142 onto which the hook 140 latches. The hook 140 is formed in one of the lower couplings 134, and the projection 142 is formed in the other lower coupling 134. This configuration allows a user to quickly and easily lock the device 100 in the upright exercise position, and when they are done using it, the user simply lifts up the device 100, by pulling on the upper frame 104, which disengages the hook 140 from the projection 142, and allows the device 100 to collapse into the collapsed position. The collapsed position is ideal because the device 100 takes up significantly less space than in its upright position, making the device 100 easy to move and store.

Optionally, in an alternate version of the linking structure 116, the pair of upper couplings 132 can be coupled or optionally fused together and the pair of lower couplings 134 can be coupled or optionally fused together and a ball joint can be located between the fused upper couplings 132 and the fused lower couplings 134. The lower couplings 134 can comprise the female portion of the ball joint, and the upper couplings 132 can comprise the male portion of the ball joint (or vice versa), and such a configuration would allow the upper frame 104 to pivot/rotate with respect to the lower frame 102.

Figure 8:
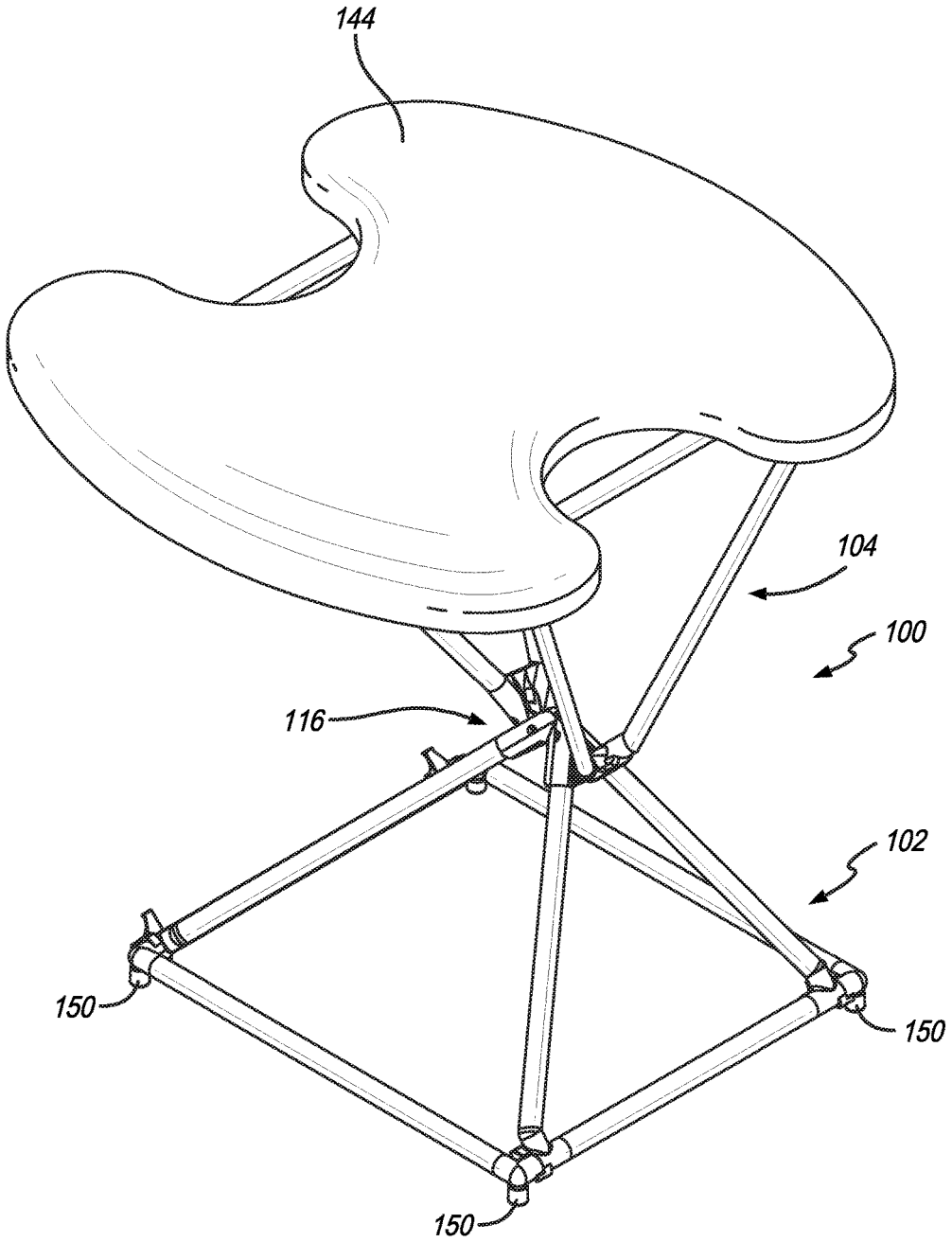
FIG. 8 is a perspective view of the exercise device of FIG. 1, wherein a seat has been coupled to the top portion of the device.
Figure 9:
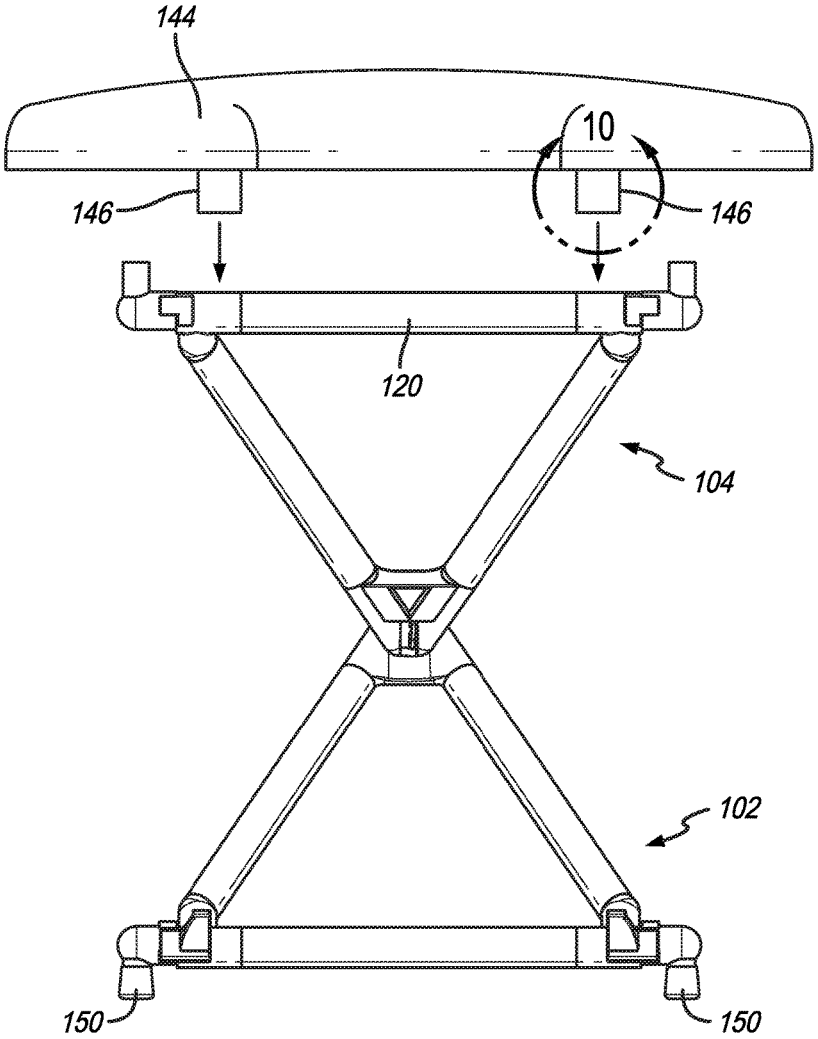
FIG. 9 is a side view of the exercise device of FIG. 8, wherein the coupling of the seat is shown with an arrow.
Figure 10:
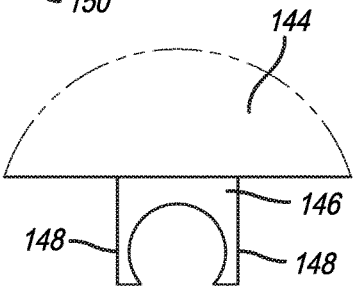
FIG. 10 is a detail side view of the coupling mechanism of the seat in FIG. 9.

Referring now to FIGS. 8-10, the device 100 can also have a seat 144 that can be removeably coupled to the top structure 120. The seat 144 couples to the top structure 120 utilizing one or more clips 146, preferably four clips 146, two on each side of the top structure 120. The clips 146 have two arms 148, such that an approximately circular opening is formed so that they easily snap over and mate with the tubes that form the top structure 120. However, the tubes forming the top structure 120 may not have circular cross-sections, accordingly the openings formed by the arms 148 could be any shape such that they easily mate with whatever shape the tubes are. Optionally, the seat 144 can be coupled to the top structure 120 by a swivel mechanism that permits the seat 144 to rotate 360 degrees.

Additionally, rather than having a seat 144, the device 100 can also have other attachments coupled to the top structure 120. Additional attachments can include, for example, a 3D maze game board and a small ball that can roll through the maze, depending on how the game board (and consequently upper frame 104) is tilted. This game board set up can be used for targeting specific muscle groups during a workout or physical therapy session. The device 100 can also have foot stir-ups coupled to the top structure 120, for a user to stand up on the device 100. Other attachments can include tension straps for creating more resistance and consequently a harder workout, and a table top with a lock so that it can be locked in an upright, level position.

Optionally, as shown in FIGS. 1, 2, 8 and 9, the lower frame 102 can comprise a plurality of feet 150, preferably one foot 150 coupled to each corner of the lower frame 102.

A method of using a device useful for exercise, the method comprising the steps of: a) obtaining the device 100 in the collapsed position; b) moving the device 100 into the upright position; and c) pivoting the upper frame 104 relative to the lower frame 102, thus exercising.

Optionally, the method can further comprise the step of coupling a seat 144 to the top structure 120.

Although the invention has been described in terms of a preferred embodiment, nevertheless, changes and modifications can be made which do not depart from the spirit, scope and teachings of the invention. Such changes and modifications are deemed to fall within the purview of the present invention as claimed.

What is claimed is:

1. A device useful for exercise, the device having a collapsed position and an upright exercise position, the device comprising:

a) a collapsible lower frame collapsible from a lower frame upright exercise position to a lower frame collapsed position, the collapsible lower frame comprising:
   (i) a base structure; and
   (ii) lower frame posts supported by the base structure, each lower frame post having an upper portion and a lower portion pivotably connected to the base structure with the lower frame post upper portions linked together by a linking structure such that the lower frame posts form a pyramid structure in the lower frame upright exercise position and can collapse from the lower frame upright exercise position to the lower frame collapsed position with the base structure and lower frame posts in substantially a lower frame collapsed plane; and b) a collapsible upper frame collapsible from an upper frame upright exercise position to an upper frame collapsed position, the collapsible upper frame comprising:
   (i) a top structure; and
   (ii) upper frame posts having a lower portion and an upper portion pivotally connected to the top structure, with the upper frame post lower portions linked together by the linking structure such that the upper frame posts form an inverted pyramid in the upper frame upright exercise position, wherein the upper frame can collapse from the upper frame upright exercise position to the upper frame collapsed position with the top structure and posts in an upper frame collapsed plane;

wherein the linking structure connects the upper frame to the lower frame such that the upper frame can pivot relative to the lower frame when the device is in its upright exercise position.

2. The device of claim 1, wherein the lower frame comprises four lower frame posts forming a first and a second pair of lower frames posts, and the upper frame comprises four upper frame posts forming a first and a second pair of upper frames posts.

3. The device of claim 2, wherein the linking structure comprises two upper couplings and two lower couplings, wherein one upper coupling is coupled to the first pair of upper frame posts, the other upper coupling is coupling to the second pair of upper frame posts, one lower coupling is coupled to the first pair of lower frame posts and the other lower coupling is coupling is coupled to the second pair of lower frame posts.

4. The device of claim 3, wherein each upper coupling is pivotally connected to a lower coupling by a connector.

5. The device of claim 1, further comprising a latch for securing the lower frame posts in the lower frame upright exercise position and the upper frame posts in the upper frame upright exercise position.

6. The device of claim 3, further comprising a latch for securing the lower frame posts in the lower frame upright exercise position and the upper frame posts in the upper frame upright exercise position.

7. The device of claim 6, wherein the latch comprises a hook formed in one of the lower couplings and a projection formed in the other lower coupling, the hook configured to latch onto the projection, such that when latched, the lower frame posts are locked in the lower frame upright exercise position and the upper frame posts are locked in the upper frame upright exercise position.

8. The device of claim 1, further comprising a seat removeably coupled to the top structure.

9. The device of claim 1 wherein the base structure is rectangularly shaped, having four corners and the lower frame comprises four lower frame posts, one lower frame post coupled to the base structure proximate each corner of the base structure.

10. The device of claim 9, wherein each of the four lower frame posts are pivotally connected to the base structure by a hinge.

11. The device of claim 1 wherein the top structure is rectangular shaped having four corners and the upper frame comprises four upper frame posts, one upper frame post coupled to the top structure proximate each corner of the top structure.

12. The device of claim 11, wherein each of the four upper frame posts is pivotally connected to the top structure by a hinge.

13. The device of claim 1, further comprising a plurality of feet coupled to the lower frame.

14. A method of using a device useful for exercise, the method comprising the steps of:

a) obtaining the device of claim 1 in the collapsed position;

b) moving the device into the upright exercise position; and c) pivoting the upper frame relative to the lower frame, thus exercising.

15. The method of claim 14, further comprising the step of coupling a seat to the top structure.

* * * * *